US008131398B2

(12) United States Patent
Fan et al.

(10) Patent No.: US 8,131,398 B2
(45) Date of Patent: Mar. 6, 2012

(54) AUTOMATIC CARD DISPENSER

(75) Inventors: Chen-Jyh Fan, Hisinchu County (TW); Hui-Chuan Chen, Hsinchu (TW); Ching-Tsung Cheng, Taipei County (TW); Shu-Ju Hsieh, Taichung County (TW); Chun-Te Yu, Yunlin County (TW)

(73) Assignee: Industrial Technology Research Institute, Hsin-Chu (TW)

( * ) Notice: Subject to any disclaimer, the term of this patent is extended or adjusted under 35 U.S.C. 154(b) by 171 days.

(21) Appl. No.: 12/481,780

(22) Filed: Jun. 10, 2009

(65) Prior Publication Data

US 2010/0163570 A1 Jul. 1, 2010

(30) Foreign Application Priority Data

Dec. 31, 2008 (TW) ..... 97151630 A

(51) Int. Cl.
*G06F 17/00* (2006.01)

(52) U.S. Cl. ..... 700/243; 700/233; 700/242; 700/232; 221/221; 221/13

(58) Field of Classification Search ..... 700/232, 700/233, 242, 243; 221/9–13, 221
See application file for complete search history.

(56) References Cited

U.S. PATENT DOCUMENTS

| | | | | |
|---|---|---|---|---|
| 3,978,571 | A * | 9/1976 | Orlando et al. | 29/730 |
| 4,993,587 | A * | 2/1991 | Abe | 221/21 |
| 4,995,498 | A * | 2/1991 | Menke | 194/205 |
| 6,102,248 | A * | 8/2000 | Yamamiya | 221/211 |
| 6,168,151 | B1 | 1/2001 | Tsuchida | |
| 6,311,867 | B1 * | 11/2001 | Yamamiya | 221/217 |
| 6,651,841 | B2 * | 11/2003 | Tsuchida | 221/251 |
| 7,377,507 | B2 * | 5/2008 | Yamamiya | 271/11 |
| 7,494,414 | B2 * | 2/2009 | Hedrick et al. | 463/20 |
| 7,748,619 | B2 * | 7/2010 | Martin et al. | 235/381 |
| 7,980,420 | B2 * | 7/2011 | Yamamiya | 221/268 |
| 2005/0282627 | A1 * | 12/2005 | Hedrick et al. | 463/25 |
| 2008/0153581 | A1 * | 6/2008 | Hedrick et al. | 463/25 |
| 2009/0001095 | A1 * | 1/2009 | Yamamiya | 221/268 |

FOREIGN PATENT DOCUMENTS

| | | |
|---|---|---|
| CN | 1466103 | 1/2004 |
| CN | 1661626 | 8/2005 |
| CN | 101127087 | 2/2008 |
| TW | 334971 | 6/2008 |

OTHER PUBLICATIONS

State Intellectual Property Office of the People's Republic of China, "Office Action", Jul. 13, 2011, China.

* cited by examiner

*Primary Examiner* — Michael K Collins
(74) *Attorney, Agent, or Firm* — WPAT, PC; Justin King

(57) ABSTRACT

An automatic card dispenser is disclosed, which comprising: a base provided with a standby area, an output area, and a first track and second track parallel to each other; said standby area and output area are respectively provided on each end of the first track and second track, and each side of the dispensed card are respectively put in the first track and second track, and the first track is capable of separating from the standby area and output area; a vertical lifting unit connected to the base with a card box and a vertical driver; a horizontal pushing unit connected to the base for putting the card to contact card pressing wheel provided in the output area along the second track; and a recycling unit connected to the base and provided below the first track.

20 Claims, 6 Drawing Sheets

AUTOMATIC CARD DISPENSER

FIELD OF THE INVENTION

The present invention relates to an automatic card dispenser, and more particularly, to an automatic card dispenser capable of pushing a card horizontally.

BACKGROUND OF THE INVENTION

After the attacks on US at Sep. 11, 2001, national security is becoming the most important issue for almost every country in the world. One key issue of national security is to ensure the safety and reliability of airports, harbors, important science-technology parks, and so, on, which emphasizes, in particular, the vehicle/personnel tracking and identification. Currently, those procedures relating to safety and security control, including entrance registration, issuance of temporary identification card, or identification inspection, etc., are performed manually by security guards or service counter personnel. Although there are already some security mechanism capable of issuing identification cards automatically, the identification cards issued thereby only contain simple information including serial number, time log that are suitable for mechanical handling. With the development in radio frequency identification (RFID) technology in recent years, there are more and more security systems adopting RFID card in vehicle/personnel tracking and identification for the purpose of cutting down the manpower requirement in safety control. However, since most RFID security systems currently available are passive RFID systems with passive RFID tags that are only powered for access while in close proximity to a reader, they are only applicable in access control and spot management. That is, since such passive RFID security systems is not able to track an object effectively in real time and also can not access information in a precise and clear manner, they will not be able to response to an emergency situation quickly and efficiently.

In order to achieve precision control, real-time tracking and quick emergency response, it is required for the security systems to adopt some long-distance active RFID cards. However, such active RFID cards are usually bigger, thicker and heavier than passive cards so that they can not be issued by common card dispensers without constant malfunction and breakdown.

There are already automatic card dispensers being developed not only for security control usage but also for consumer demand that are designed for handling larger and heavier cards, such as DVD cards, parking cards with tracking control, admission cards for financial institutions, and so on.

One of which is a dispensing unit for smart card dispenser, disclosed in TW Pat. No. M334971. The aforesaid dispensing unit, being a gravity-type device that is inclinedly arranged inside a smart card dispenser, is capable of causing the friction to a sliding smart card to increase as it is being dispensed and thus reducing its sliding speed as well as it momentum for enabling the smart card to be ejected out of the card dispenser smoothly. Moreover, as the card dispensing slot of the aforesaid dispensing unit is designed as a bar-like hole, any card being dispensed is supposed to fall into the bar-like hole that is visible and eye-catching to an user for preventing the dispensed card from being forgotten and left in the card dispensing slot. In addition, as the width of the bar-like hole is smaller than the dispensed smart card, the smart card is prevented from falling out of the card dispensing slot directly.

Another such dispenser is disclosed in U.S. Pat. No. 6,168,151, entitled "Card type dispenser assembly with bottom loading", in which a card-like article is provided with an elevator assembly that can elevate a stacked array of cards to a discharge station.

Therefore, it is in need of an automatic card dispenser capable of issuing any modern cards efficiently without malfunction.

SUMMARY OF THE INVENTION

The present invention relates to an automatic card dispenser, comprising: a base, configured with a standby area, an output area, and a first track and second track parallel to each other in a manner that the standby area and output area are respectively provided on each end of the first track and second track, the standby area is further configured with a protruding unit, a sensing unit and a data accessing unit while the output area is configured with a card pressing wheel, and each side of the dispensed card are respectively put in the first track and second track while the first track is connected to a recycling structure; a vertical lifting unit, connected to the base and being configured with a card box for receiving cards therein and a vertical driver for raising the cards in the card box to the standby area; a horizontal pushing unit connected to the base for putting the card to contact card pressing wheel provided in the output area along the second track; a recycling unit, connected to the base and provided below the first track; and a control unit, electrically connected to the sensing unit, the data accessing unit, the vertical lifting unit and the horizontal pushing unit in respective.

Yet, the present invention further provides an automatic card dispensing method, comprising the steps of:

- providing an automatic card dispenser whereas the automatic card dispenser comprises: a base, configured with a standby area, an output area, a first track and second track in a manner that the first and the second tracks are arranged parallel to each other at a position between the standby area and the output area while enabling the first track to connect to a recycling structure, and the standby area is further configured with a protruding unit, a sensing unit and a data accessing unit while the output area is configured with a card pressing wheel; a vertical lifting unit, connected to the base while being configured with a card box for receiving cards therein and a vertical driver; a horizontal pushing unit connected to the base; a recycling unit, connected to the base and provided below the recycling structure; and a control unit, electrically connected to the sensing unit, the data accessing unit, the vertical lifting unit and the horizontal pushing unit in respective;
- activating the control unit for driving the vertical driver to raise the cards in the card box;
- enabling the sensing unit to issue a detection signal to the control unit as soon as it detects the cards being raised to the standby area so as to enable the control unit to stop the vertical driver and thus hold the raised cards in the standby area;
- enabling one of the cards to be activated as soon as its switch is engaged by the protruding unit;
- enabling the data accessing unit to access data from the control unit while writing the accessed data into the activated card while making an evaluation to determine whether the aforesaid writing operation is success;
- enabling the horizontal pushing unit to push the card to move toward the output area by the guidance of the second track if the writing operation is success; and enabling the recycling unit for disengaging the first track from contacting with the standby area and the output area if the writing operation failed.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
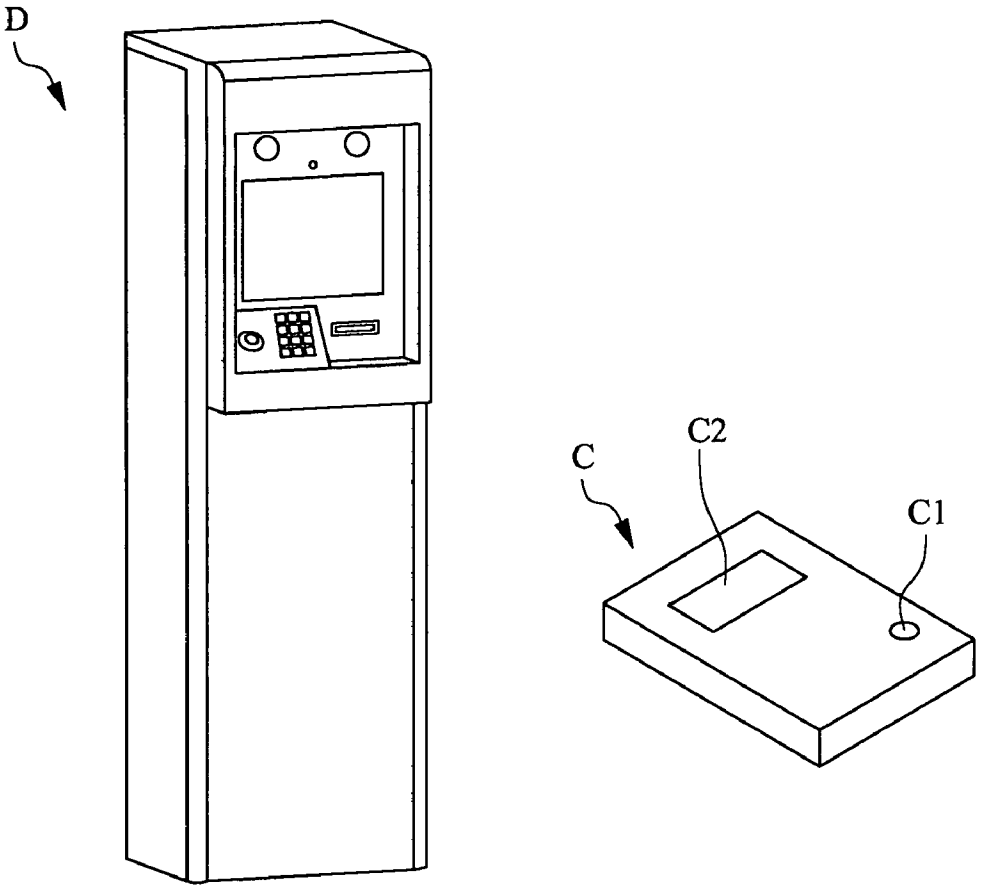
FIG. 1 is a three-dimensional view of an automatic card dispenser along with a card being dispensed thereby according to an embodiment of the invention.

Please refer to FIG. 1, which is a three-dimensional view of an automatic card dispenser along with a card being dispensed thereby according to an embodiment of the invention. In FIG. 1, the automatic card dispenser D is used for dispensing a card C which is configured with a switch C1 and a display screen C2. In this embodiment, the automatic card dispenser is designed for 8 cm×6 cm cards with thickness no less than 0.2 cm.

Figure 2:
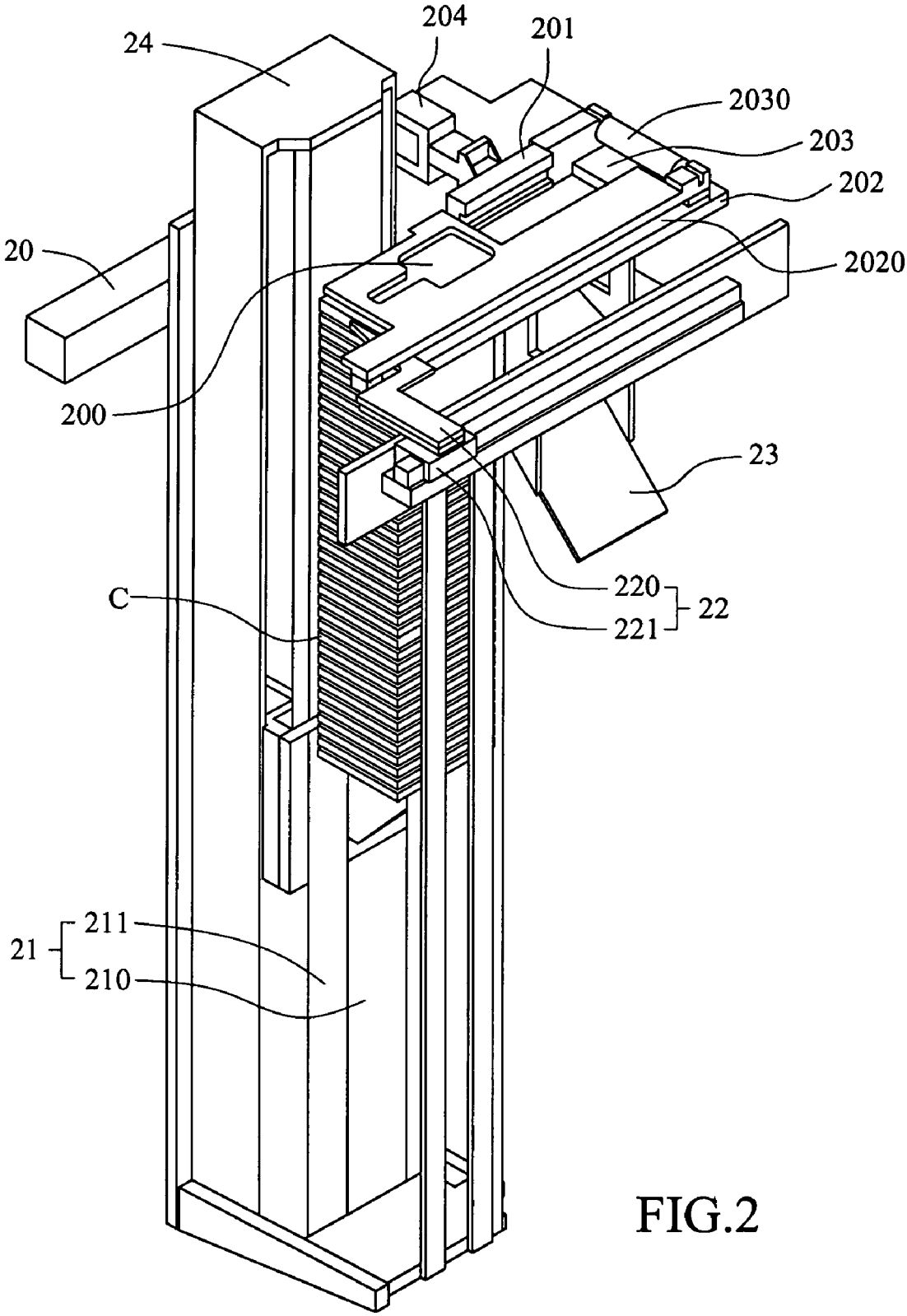
FIG. 2 is a three-dimensional diagram showing the internal structure of an automatic card dispenser according to an embodiment of the invention.
Figure 3:
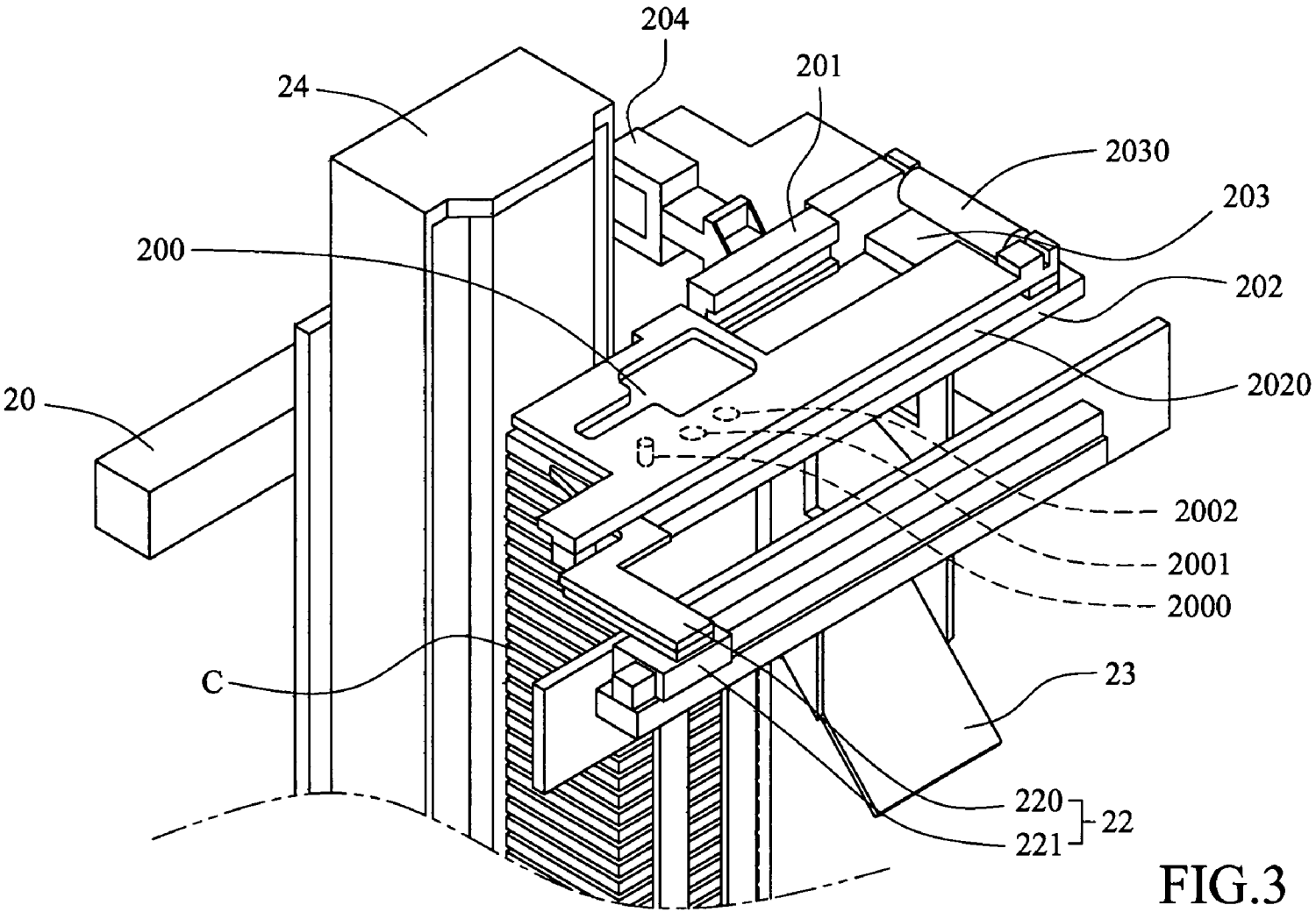
FIG. 3 is a three-dimensional enlarged diagram showing a portion of FIG. 2.
Figure 4:
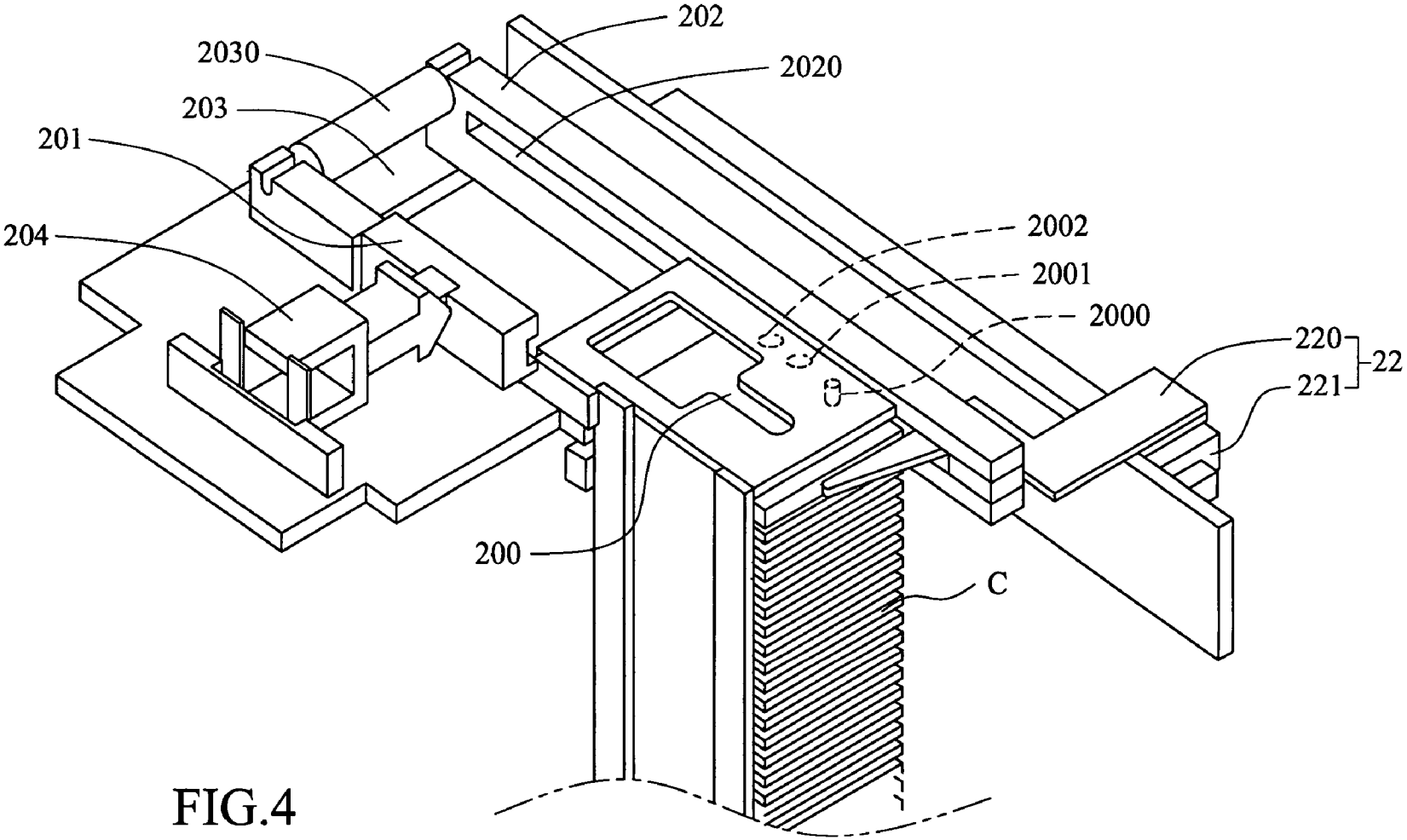
FIG. 4 is a three-dimensional enlarged diagram the same as that shown in FIG. 3 but without the control unit that is viewed from another viewing angle different from that of FIG. 3.

FIG. 2 is a three-dimensional diagram showing the internal structure of an automatic card dispenser according to an embodiment of the invention, FIG. 3 is a three-dimensional enlarged diagram showing a portion of FIG. 2, and FIG. 4 is a three-dimensional enlarged diagram the same as that shown in FIG. 3 but without the control unit that is viewed from another viewing angle different from that of FIG. 3. As shown in those figures, the automatic card dispenser comprises: a base 20, configured with a standby area 200, an output area 203, and a first track 201 and second track 202 in a manner that the first and the second tracks 201, 202 are arranged parallel to each other; a vertical lifting unit 21; a horizontal pushing unit 22; a recycling unit 23; and a control unit 24.

Moreover, the standby area 200 and output area 203 are respectively provided on each end of the first track 201 and second track 202, and the standby area is further configured with a protruding unit 2000, a sensing unit 2001 and a data accessing unit 2002 in a manner that the protruding unit 2000 is disposed at a position corresponding to the switch C1 of the card C while the sensing unit 2001 and the data accessing unit 2002 can be disposed at any position as required. In addition, the output area 203 is configured with a card pressing wheel 2030, which is used for pressing the card C that is on it way to be discharged out of the automatic card dispenser for preventing the same to be pushed to go too fast and thus fall on the ground. As the first track 201 is coupled to a recycling structure 204, the activation of the recycling structure 204 can enable the first track 201 to detach from the standby area 200 and the output area 203. Each side of each dispensed card C are respectively put in the first track 201 and second track 202 so that the dispensed card C is able to move linearly by the guidance of the first track 201 and second track 202. The vertical lifting unit 21 is connected to the base 20 and is configured with a card box 210 for receiving the dispensed cards C therein and a vertical driver 211 for vertically raising the cards C in the card box 210 to the standby area 200. The horizontal pushing unit 22 is also connected to the base 20 for putting the card C move along the first track 201 and the second track 202 to the output area 203 for enabling the same to contact with the card pressing wheel 2030. Moreover, the horizontal pushing unit 22 is composed of a push rod 220 and an induction motor 221 that is used for driving the push rod 220. The second track 202 is formed with a groove 2020 in a manner that the groove 2020 is disposed parallel with the second track 202 and the groove 2020 whose thickness is smaller than the dispensed card C is used for receiving the push rod 220 therein. The recycling unit 23 is formed like a ramp that is disposed under the recycling structure 204 and connected to the base 20. Thereby, when the first track 201 is detach form contacting with the standby area 200 and the output area 203 by the activation of the recycling structure 204, the card C that is pushed by the horizontal pushing unit 22 to the output area will flip by lacking the support of the first track 201 and thus fall onto the ramp-like recycling unit 23 where it is send to a card recycle mechanism. The control unit 24 is just like a miniature computer that is electrically connected to the sensing unit 2001, the data accessing unit 2002, the vertical lifting unit 211 and the horizontal pushing unit 22 in respective. The positioning of the control unit 24 shown in the aforesaid figures is only for illustration that can be changed as required.

Figure 5:
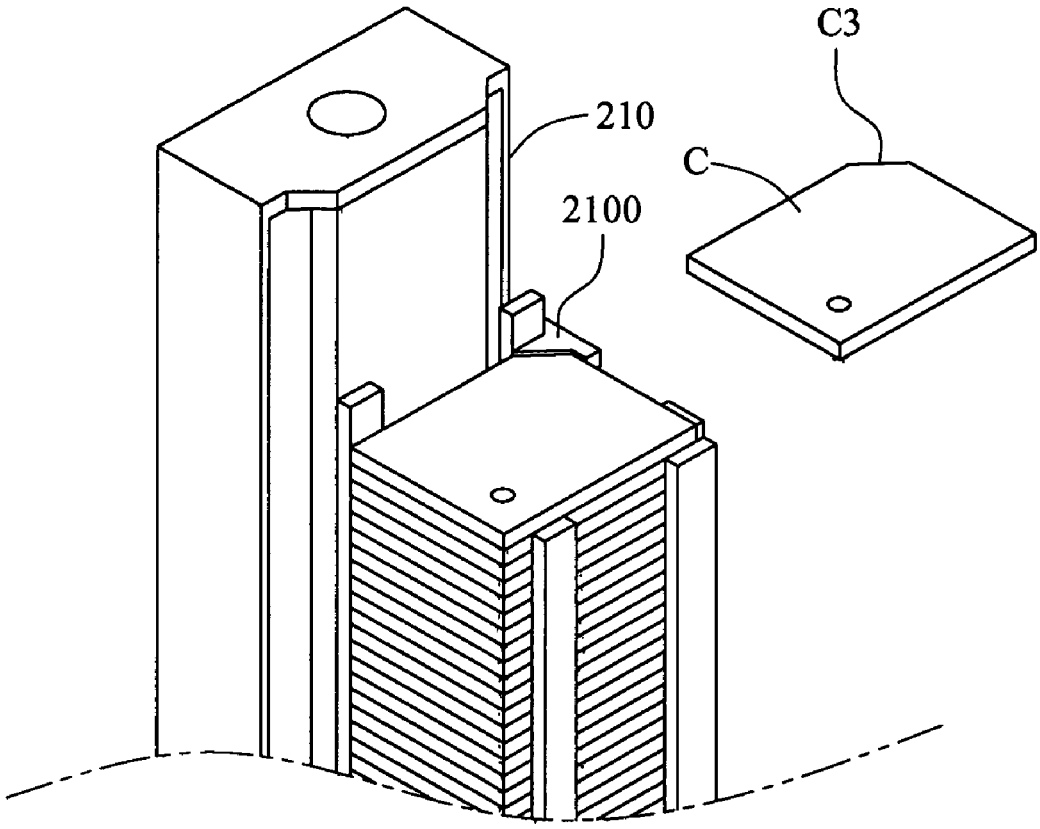
FIG. 5 is a schematic diagram showing how the card box and cards are assembled.

Please refer to FIG. 5, which is a schematic diagram showing how the card box and cards are assembled. For aligning the cards C, the card box 210 is configured with a first marker 2100, such as a bulging bar, while each card C for the card box 210 is configured with a second marker C3, such as a crevice, so that a card C can be correctly install in the card box 210 by aligning its second marker C3 with the first marker 2100.

Figure 6:
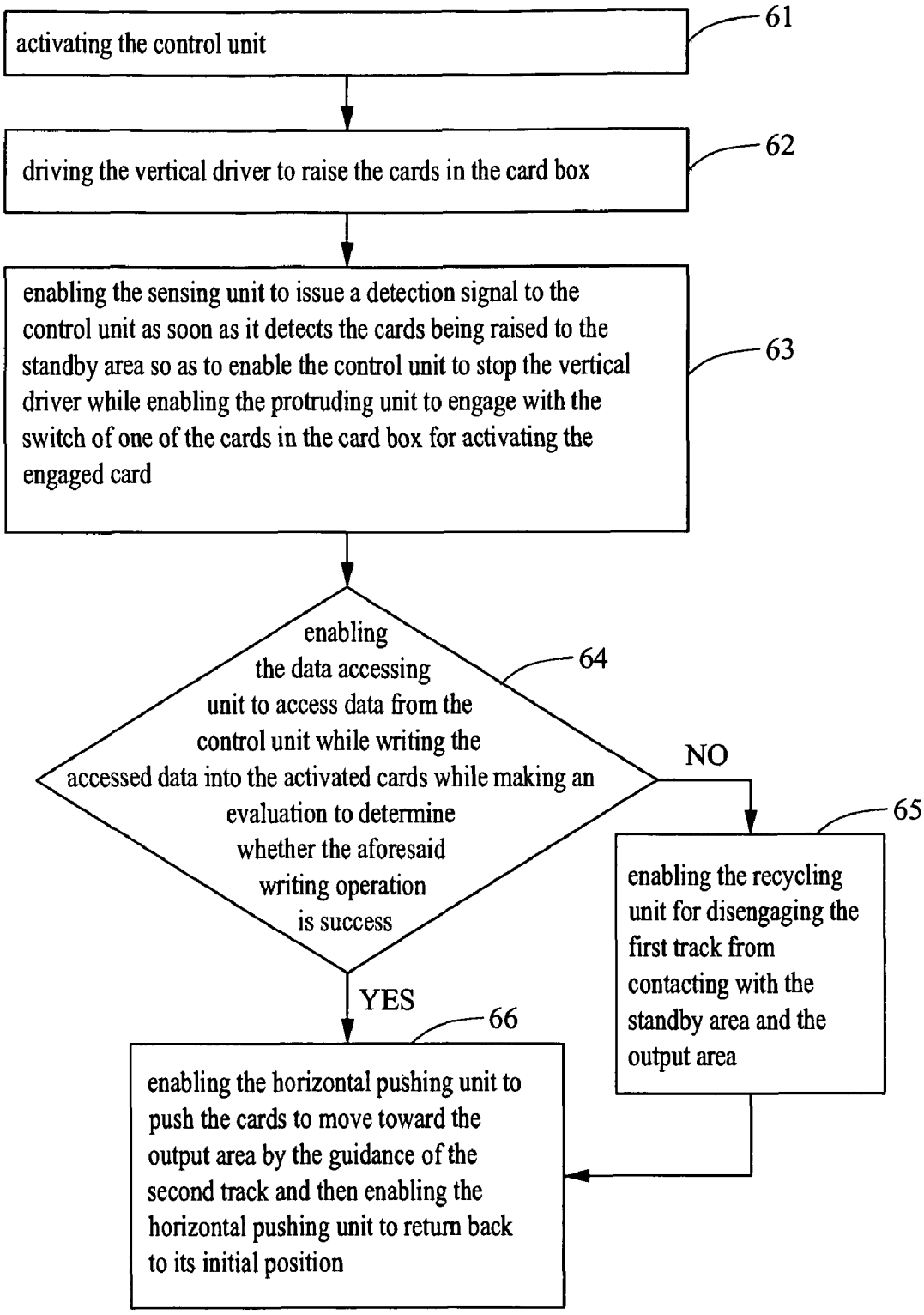
FIG. 6 is a flow chart depicting the steps of an automatic card dispensing method according to the present invention.

Please refer to FIG. 6, which is a flow chart depicting the steps of an automatic card dispensing method according to the present invention. The flow chart in the embodiment comprises the following steps:

Step 61—activating the control unit, wherein a user enables the automatic card dispenser for starting a card dispensing operation;

Step 62—driving the vertical driver, which can be a lead screw connecting to an electric motor, to raise the cards in the card box, wherein the control unit issues a command for directing the vertical driver to raise the cards in the card box;

Step 63—enabling the sensing unit to issue a detection signal to the control unit as soon as it detects the cards being raised to the standby area so as to enable the control unit to stop the vertical driver while enabling the protruding unit to engage with the switch of one of the cards in the card box for activating the engaged card; wherein as the protruding unit is arranged at a position corresponding to the switch, the switch can be engaged and thus activated by the protruding unit as soon as the card is raised and hold in a specific position in the standby area, and as soon as the card in the standby area is sensed by the sensing unit, it will issue a detection signal to the control unit for stopping the raising of the card;

Step 64—enabling the data accessing unit to access data from the control unit while writing the accessed data into the activated cards while making an evaluation to determine whether the aforesaid writing operation is success; if so, the flow proceeds to step 66; otherwise, the flow proceeds to step 65; wherein, as soon as the switch of a card is activated, the data accessing unit will access data from the control unit and then write the accessed data into the activated card, and then after completing the writing operation, a evaluation operation will be performed for determining whether the writing operation is success;

Step 65—enabling the recycling unit for disengaging the first track from contacting with the standby area and the output area; wherein, when the writing operation is failed, the control unit will activate the recycling structure to disengage the first track from the standby area and the output area, so that the card that is pushed by the horizontal pushing unit to the output area will flip by lacking the support of the first track and thus fall onto the ramp-like recycling unit where it is send to a card recycle mechanism for preventing the same from being dispensed by the automatic card dispenser;

Step 66—enabling the horizontal pushing unit to push the cards to move toward the output area by the guidance of the second track and then enabling the horizontal pushing unit to return back to its initial position; wherein, the card pushed to the output area will be pinched by the card pressing wheel for preventing the same from keeping moving forward by inertia and thus falling out of the automatic card dispenser.

In an embodiment of the invention, the first track and the second track can be made of Teflon, by that the wear and tear of the two tracks caused by friction can be prevented. In addition, the sensing unit can be a photoelectric sensor.

To sum up, the automatic card dispenser is a rear-pushing type card dispenser which is different from those conventional roller-type card dispenser in that: not only it can be adapted for dispensing those thicker smart cards, but also it is capable of working independently as an automatic card dispenser without human supervision.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic card dispenser, comprising:

a base, configured with a standby area, an output area, and a first track and second track in a manner that the first and the second tracks are arranged parallel to each other, the standby area and output area are respectively provided on each end of the first track and second track, the standby area is further configured with a protruding unit, a sensing unit and a data accessing unit while the output area is configured with a card pressing wheel, and each side of each dispensed card are respectively put in the first track and second track while the first track is connected to a recycling structure;

a vertical lifting unit, connected to the base and being configured with a card box for receiving the dispensed cards therein and a vertical driver for raising the cards in the card box to the standby area;

a horizontal pushing unit, connected to the base for enabling the card to move along the second track and contact the card pressing wheel;

a recycling unit, connected to the base and provided below the recycling structure; and a control unit, electrically connected to the sensing unit, the data accessing unit, the vertical lifting unit and the horizontal pushing unit in respective.

2. The automatic card dispenser of claim 1, wherein the first track is made of Teflon.

3. The automatic card dispenser of claim 1, wherein the second track is made of Teflon.

4. The automatic card dispenser of claim 1, wherein the sensing unit is a photoelectric sensor.

5. The automatic card dispenser of claim 1, wherein the card box is configured with a first marker while each card for the card box is configured with a second marker, and a card is correctly install in the card box by aligning its second marker with the first marker.

6. The automatic card dispenser of claim 5, wherein the first marker is formed as a bulging bar and the second marker is formed as a crevice.

7. The automatic card dispenser of claim 1, wherein the vertical driver is a lead screw connecting to an electric motor.

8. The automatic card dispenser of claim 1, wherein each dispensed card is no thinner than 0.2 cm.

9. The automatic card dispenser of claim 1, wherein the horizontal pushing unit is composed of a push rod and an induction motor connected to the push rod for driving the same.

10. The automatic card dispenser of claim 9, wherein there is a groove whose thickness is smaller than the dispensed card is parallel-formed on the second track for receiving the push rod therein.

11. An automatic card dispensing method, comprising the steps of:

providing an automatic card dispenser whereas the automatic card dispenser comprises: a base, configured with a standby area, an output area, a first track and second track in a manner that the first and the second tracks are arranged parallel to each other at a position between the standby area and the output area while enabling the first track to connect to a recycling structure, and the standby area is further configured with a protruding unit, a sensing unit and a data accessing unit while the output area is configured with a card pressing wheel; a vertical lifting unit, connected to the base while being configured with a card box for receiving cards therein and a vertical driver; a horizontal pushing unit connected to the base; a recycling unit, connected to the base and provided below the recycling structure; and a control unit, electrically connected to the sensing unit, the data accessing unit, the vertical lifting unit and the horizontal pushing unit in respective;

activating the control unit for driving the vertical driver to raise the cards in the card box;

enabling the sensing unit to issue a detection signal to the control unit as soon as it detects the cards being raised to the standby area so as to enable the control unit to stop the vertical driver and thus hold the raised cards in the standby area;

enabling one of the cards to be activated as soon as its switch is engaged by the protruding unit;

enabling the data accessing unit to access data from the control unit while writing the accessed data into the activated card while making an evaluation to determine whether the aforesaid writing operation is success;

enabling the horizontal pushing unit to push the card to move toward the output area by the guidance of the second track if the writing operation is success, and then enabling the horizontal pushing unit to travel back to it its initial position; and enabling the recycling unit for disengaging the first track from contacting with the standby area and the output area if the writing operation failed.

12. The method of claim 11, wherein the first track is made of Teflon.

13. The method of claim 11, wherein the second track is made of Teflon.

14. The method of claim 11, wherein the sensing unit is a photoelectric sensor.

15. The method of claim 11, wherein the card box is configured with a first marker while each card for the card box is configured with a second marker, and a card is correctly install in the card box by aligning its second marker with the first marker.

16. The method of claim 15, wherein the first marker is formed as a bulging bar and the second marker is formed as a crevice.

17. The method of claim 11, wherein the vertical driver is a lead screw connecting to an electric motor.

18. The method of claim 11, wherein each dispensed card is no thinner than 0.2 cm.

19. The method of claim 11, wherein the horizontal pushing unit is composed of a push rod and an induction motor connected to the push rod for driving the same.

20. The method of claim 19, wherein there is a groove whose thickness is smaller than the dispensed card is parallel-formed on the second track for receiving the push rod therein.

* * * * *